United States Patent [19]

Winsor

[11] Patent Number: 4,986,406

[45] Date of Patent: Jan. 22, 1991

[54] ANTI-THEFT PARKING METER ANCHORING DEVICE

[76] Inventor: B. Drew Winsor, 165 Selborne Way, Morage, Calif. 94556

[21] Appl. No.: 417,274

[22] Filed: Oct. 5, 1989

[51] Int. Cl.[5] ..... G07F 9/00

[52] U.S. Cl. ..... 194/350; 403/379

[58] Field of Search ..... 194/350; 403/378, 379, 403/324; 232/15, 16; 368/90, 91, 92

[56] References Cited

U.S. PATENT DOCUMENTS

| | | | |
|---|---|---|---|
| ,798,273 | 1/1989 | Ward, II | 194/350 |
| 2,311,242 | 2/1943 | Michaels | 368/90 X |
| 3,231,180 | 1/1966 | Wellekens | 232/15 |
| 3,268,158 | 8/1966 | Abbott | 232/15 |
| 3,721,463 | 3/1973 | Attwood et al. | 403/258 |
| 4,884,914 | 12/1989 | Schultz | 403/324 X |

*Primary Examiner*—Robert J. Spar
*Assistant Examiner*—William M. Heinz
*Attorney, Agent, or Firm*—Flehr, Hohbach, Test, Albritton & Herbert

[57] ABSTRACT

An anti-theft device for anchoring a parking meter head to the top of a support post. The device includes a metal capture cylinder formed with a lateral bore which receives a double-headed locking pin, the heads of which are adapted to fit within a pair of transverse openings formed through the post. A clamping bolt accessible from inside the vault of the meter head is operated to draw the cylinder upwardly toward the base of the meter to a secure position where the locking pin is captured in a manner which prevents unintended removal.

4 Claims, 2 Drawing Sheets

ANTI-THEFT PARKING METER ANCHORING DEVICE

BACKGROUND OF THE INVENTION

This invention relates in general to parking meters, and more particularly relates to anchoring devices for parking meters to prevent theft and tampering.

Conventional anti-theft parking meter devices include an expanding anchor nut and wedge assembly which fits within the hollow post supporting the meter. When a clamping bolt is tightened the wedge elements expand outwardly and tightly jam against the inner surface of the post. Although effective in many cases of attempted theft, the anchor nut and wedge design can fail when sufficient force is exerted against the bottom of the meter base, such as by sharply striking the base upwardly with a heavy object. After being repeatedly struck with sharp blows in this manner, the meter can be knocked off of the post.

Another conventional anti-theft expedient is to drill a hole through the side of the pipe and meter base and then drive a hardened lock pin through the holes to a depth flush with the outer diameter of the pipe. An outer sleeve can then be mounted about the upper end of the pipe. Designs of this type have not been completely successful in that the meters can still be knocked from the posts due to the relatively weak holding force of the pin. In addition, this design makes it difficult and time consuming to remove the meter for repair or replacement in that the maintenance worker must drive the pin completely through the hole to remove the meter.

OBJECTS AND SUMMARY OF THE INVENTION

It is accordingly an object of the present invention to provide a new and improved anti-theft device for anchoring a parking meter head to a support post.

Another object is to provide an anti-theft device of the type described which is more secure in holding the meter against tampering such as from sharp blows from a heavy object.

Another object is to provide an anti-theft device of the type described which is relatively easy to install, and which can be readily removed for repair or maintenance of the meter.

Another object is to provide an anti-theft device of the type described which employs only a relatively few number of parts which can be easily and inexpensively fabricated.

Another object is to provide an anti-theft device of the type described employing a locking pin which is secured against attempts by a thief to drive the pin out and remove the meter.

The present invention in summary provides a metal capture cylinder which fits within the upper end of the post. A lateral bore is formed diametrically through the cylinder for receiving a double-headed locking pin. A clamping bolt engages a threaded hole in the upper end of the cylinder to mount the meter head onto the post. The locking pin is inserted sideways through one of two transverse openings in the post with the shank of the pin centered in the lateral bore of the cylinder. The clamping bolt is then tightened to draw the cylinder upwardly toward the base of the meter, thereby capturing the locking pin in a manner which prevents unintended removal.

The foregoing and additional objects and features of the invention will appear from the following specification in which the several embodiments have been set forth in detail in conjunction with the accompanying drawings.

DESCRIPTION OF THE PREFERRED EMBODIMENTS

Figure 1:
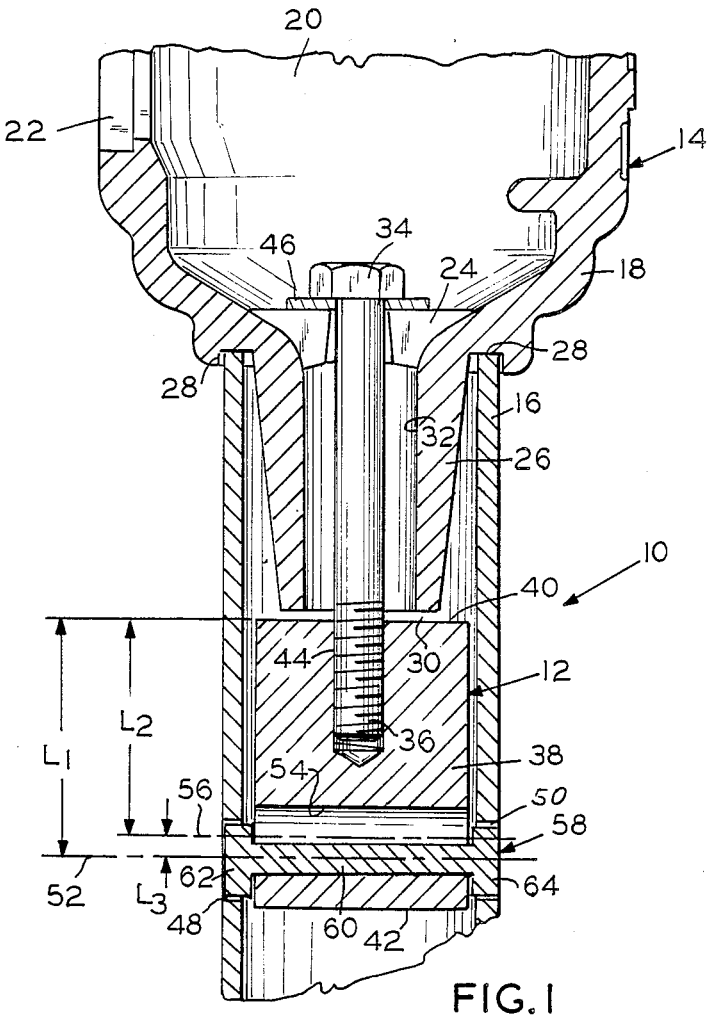
FIG. 1 is an axial section view of a parking meter head and pipe post showing the anchoring device of the invention.
Figure 2:
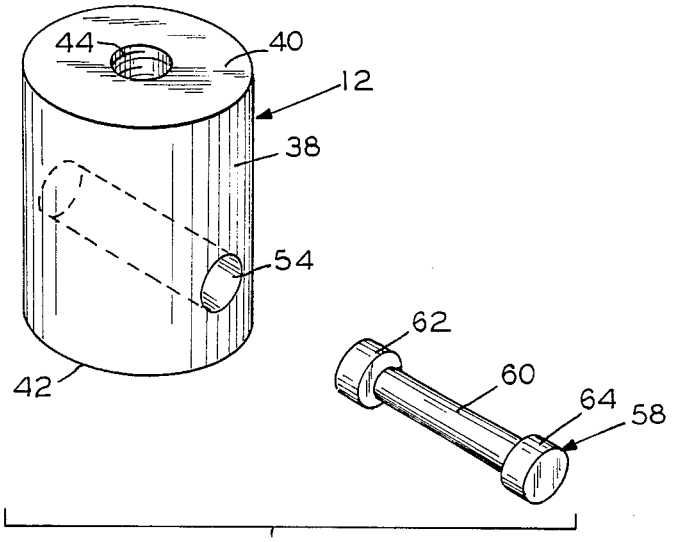
FIG. 2 is a perspective, exploded view of component elements of the anchoring device employed in FIG. 1.

In the drawings FIG. 1 illustrates generally at 10 a parking meter installation incorporating an anti-theft anchoring device 12 in accordance with one embodiment of the invention. Parking meter installation 10 includes a meter head 14 mounted at the top of a post 16 which in turn is embedded at its lower end into a solid base, such a concrete sidewalk. Post 16 typically is a hollow pipe having a 2.0" inner diameter and a 2.375" outer diameter. The meter head comprises a metal housing 18 which encloses a vault chamber 20. A keyed vault door 22 is provided in one side of the housing. A conventional operating mechanism, not shown, for receiving the coins and indicating the available time is contained within the upper meter housing.

The housing 18 of the meter head is formed at its lower end with a mounting base 24 which includes a portion 26 that tapers downwardly and is sized to fit within the pipe post. A downwardly facing circular groove 28 at the upper end of the mounting base is sized to fit with the upper rim of the post. Lower end 30 of the tapered portion projects downwardly approximately 2-3/16" from the base of groove 28. The mounting base is formed coaxially with a vertical channel or bore 32 which is sized to receive a clamping bolt 34, which preferably is a ½" nominal diameter bolt having a threaded lower distal end 36.

Meter anchoring device 12 includes a capture cylinder 38 having a flat upper end 40 and lower end 42. The cylinder has a circular outer diameter sized commensurate with the inner diameter of the pipe post with sufficient clearance to permit the cylinder to be freely inserted and withdrawn from the top of the pipe. Preferably cylinder 38 is formed of a suitable high strength metal such as heat treated and hardened 4140 steel. An internally threaded hole 44 having a nominal diameter equal to that of clamping bolt 34 is formed coaxially down into the upper end of the cylinder. A washer 46 is provided between the bolt head and mounting base 24. The bolt head is accessible from within the vault chamber when the vault door is opened. When the clamping bolt is turned down by a wrench or other tool the capture cylinder is drawn upwardly until the lateral bore of the cylinder tightly abuts the locking pin.

A pair of co-aligned circular transverse openings 48 and 50 are formed through post 16 at diametrically opposed positions. The common centerline 52 of the transverse openings is set at a position below the upper end of the pipe so that this centerline will be at a predetermined length $L_1$ below the lower end of the mounting base when the latter is mounted on the top of the post. A lateral bore 54 is also formed diametrically through the cylinder, and the bore has a diameter substantially equal to that of the transverse openings in the post. The centerline 56 of the lateral bore is spaced from cylinder upper end 40 at a length $L_2$ which is less than length $L_1$ by a predetermined shift differential $L_3$.

Meter anchoring device 12 includes a double-headed locking pin 58 which preferably is formed of a high strength metal. The locking pin is comprised of an elongate shank 60 integrally formed at its opposite ends with a pair of enlarged heads 62 and 64. The heads are sized to slidably fit through lateral bore 54 as well as the two transverse openings 48, 50 in the pipe. As a preferred example, the lateral bore and transverse openings can be formed with ⅜" diameters with the outer diameter of the pin heads nominally less than ⅜". With this dimensioning the outer diameter of pin shank 60 preferably is on the order of 5/16". This provides a radial spacing from one side of the shank to the edge of the enlarged heads of 5/32". The axial length of the locking pin measured from opposite ends of the heads is commensurate with the outer diameter of the pipe so that when the pin is installed the outer ends of the heads are seated near the outer edges of the transverse openings in the pipe.

Figure 4:
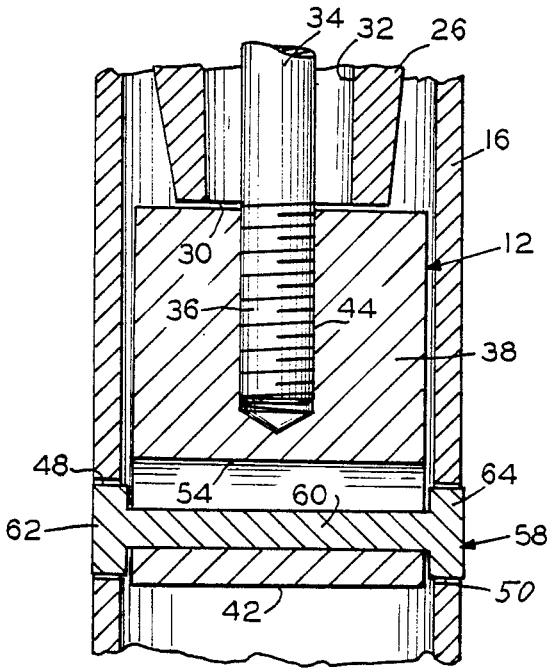
FIG. 4 is an axial section view similar to FIG. 3 showing the anchoring device in its secured position.

The shift differential is defined by the distance between the centerlines 52 and 56 and is set at a predetermined length $L_3$ so that when the capture cylinder is drawn up by the clamping bolt toward the mounting base, the lower side edges of the lateral bore move up to a level above the lower sides of the pin heads, as shown in the "secured" configuration of FIG. 4. In the specific example describe above the shift differential length $L_3$ is substantially 5/16". When the capture cylinder is shifted upwardly through this shift differential relative to the heads then the capture cylinder is brought into a sideways interference fit with the heads, thereby preventing sideways withdrawal of the locking pin.

Figure 3:
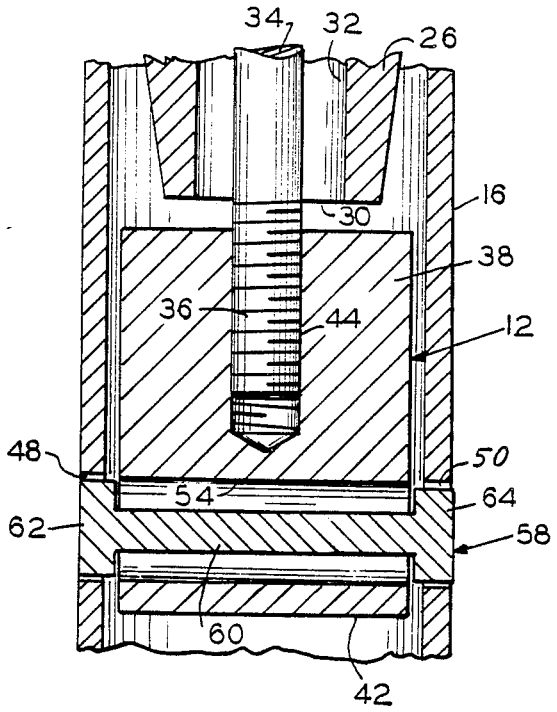
FIG. 3 is a fragmentary axial section view of the apparatus of FIG. 1 showing an initial step in installation of the anchoring device.

For installing the meter anchoring device, the meter head is removed from the post. Clamping bolt 34 with washer 46 are inserted down through bore 32 and into the bolt hole of capture cylinder 38. The clamping bolt is then turned down to draw the capture cylinder upwardly until its upper end 40 is spaced from the lower end 28 of the mounting base a distance equal to the 5/16" shift differential. The capture cylinder, with the meter head on top, is then inserted down through the top of the post to the "assembly/disassembly" position shown in FIG. 3 where the centerlines of the lateral bore and transverse openings are substantially in alignment. The locking pin 58 is then inserted through one of the transverse openings to the position where it is centered within the lateral bore. At this position the enlarged heads 62 and 64 are seated within the transverse openings, while the inner edges of the heads radially clear the outer diameter of the capture cylinder permitting axial movement of the cylinder. Clamping bolt 34 is again turned to draw the capture cylinder upwardly into tight fitting engagement against the lower side of the locking pin. The capture cylinder moves through the shift differential $L_3$ to the secured position shown in FIG. 4. In this position the cylinder captures the locking pin against lateral movement. Should an attempt be made to drive the pin out by striking inwardly against either head, movement of the head will be blocked by the upwardly drawn portion of the capture cylinder. In addition, in the secure position shown in FIG. 4 the seating of the heads within the transverse openings prevents the heads from being struck and sheared off by blows from the outside.

Meter anchoring device 12 permits easy disassembly for repair and maintenance without the requirement of cutting the post off, as would be the case with certain conventional anti-theft devices. The vault door is first opened for access to the clamping bolt within the meter vault. A wrench is used to back clamping bolt 34 off sufficient to release capture cylinder 38 so that it moves down through the shift differential distance $L_3$ until lateral bore 54 is brought into alignment with the transverse openings of the post. The capture cylinder is no longer in an interference fit with the locking pin, which then is easily removed sideways through either one of the transverse openings. The meter head and capture cylinder are then lifted upwardly and away from the post.

The invention also contemplates that the meter anchoring device could include a separate sleeve pipe, not shown, having an inner diameter commensurate with the outer diameter of post 16. The sleeve pipe can be mounted to freely rotate about the upper end of the post to cover the exposed ends of the locking pin heads, and provide additional security against tampering.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. An anti-theft device for anchoring a parking meter head to the top of a hollow support post which is formed with a pair of diametrically opposed transverse openings, the device comprising the combination of a capture cylinder sized to slidably fit within the post, the cylinder having a diametrical lateral bore, a locking pin comprising a shank which supports at its opposite ends a pair of heads, said heads having diameters sized to slidably fit through the transverse openings and through the lateral bore, said shank having a diameter less than the head diameters, and clamping means for holding the capture cylinder below the head in a first position in which the lateral bore is aligned with the transverse openings for insertion therethrough of the locking pin, said clamping means moving the cylinder upwardly in clamped relationship toward the meter head to a secure position where the lower portion of the bore is drawn up against the shank and lies between lower portions of the heads to prevent sideways withdrawal of the locking pin.

2. An anti-theft device as in claim 1 in which the meter head includes a mounting base having a lower end which projects downwardly within the top of the post, said lower end being formed with a vertical opening concentric with the mounting base, and the clamping means comprises a bolt which extends down through the opening in said lower end, and means for threadably engaging the distal end of the bolt with the clamping cylinder by which turning of the bolt in one direction draws the cylinder upwardly into clamping engagement toward the lower end of the head for the secure position and in which turning of the bolt in an opposite direction moves the cylinder downwardly to the first position with the lateral bore in alignment with the transverse openings whereby the locking pin can be inserted or withdrawn therefrom.

3. An anti-theft device as in claim 2 in which the common centerline of the transverse openings is at a predetermined length $L_1$ below the lower end of the mounting base when the latter is mounted on top of the post, and the transverse centerline of the lateral bore is spaced from the cylinder upper end at a length $L_2$ which is less than said length $L_1$ by a predetermined shift differential $L_3$ with said capture cylinder shifting through a distance substantially equal to $L_3$ when the capture cylinder moves from its first position toward its secure position.

4. An anti-theft device for anchoring a parking meter head to the top of a support post having a vertical cylindrical bore with a given inner diameter, the meter head having a mounting base shaped to project concentrically within the bore down from the top of the post with the mounting base terminating at a lower end, the mounting base also having a vertical channel coaxial therewith for receiving a clamping bolt, said post being formed with a pair of diametrically opposed circular transverse openings with centerlines positioned at a predetermined length below the lower end of the mounting base when the latter is mounted on the top of the post, said device comprising the combination of a capture cylinder having an outer diameter sized to fit within the cylindrical bore of the post, the cylinder having upper and lower spaced-apart ends, said upper end formed with a threaded hole for receiving a threaded distal end of the bolt, a lateral bore formed diametrically through the cylinder with the centerline of the lateral bore spaced from the cylinder upper end by a distance which is less than said predetermined length by a shift differential, a locking pin having an elongate shank and a pair of enlarged heads formed at opposite ends of the shank, said enlarged heads having outer diameters commensurate with the diameters of the lateral bore and of the transverse openings to permit the pin to be inserted into and removed from said bore and openings when they are in coaxial alignment, said shank having an outer diameter which is sufficiently less than the diameter of the lateral bore to permit the cylinder to move upwardly relative to the mounting base through at least a portion of the shift differential when the clamping bolt engages said threaded hole and draws the cylinder upper end toward the lower end of the mounting base whereby lateral disengagement of the locking pin from the capture cylinder is prevented due to engagement of either of the enlarged heads with portions of the capture cylinder surrounding the lateral bore.

* * * * *